US011492896B2

(12) United States Patent
Klenner et al.

(10) Patent No.: US 11,492,896 B2
(45) Date of Patent: Nov. 8, 2022

(54) PROCESS FOR INFILL WELL DEVELOPMENT IN A SUBSURFACE RESERVOIR

(71) Applicants: Robert Klenner, Grand Forks, ND (US); Guoxiang Liu, Edmond, OK (US); Hayley Stephenson, Edmond, OK (US); Glenn Richard Murrell, Laramie, WY (US); Mahendra Ladharam Joshi, Katy, TX (US); Dewey L. Parkey, Jr., Magnolia, TX (US); Naresh Sundaram Iyer, Ballston Spa, NY (US); Nurali Virani, Niskayuna, NY (US)

(72) Inventors: Robert Klenner, Grand Forks, ND (US); Guoxiang Liu, Edmond, OK (US); Hayley Stephenson, Edmond, OK (US); Glenn Richard Murrell, Laramie, WY (US); Mahendra Ladharam Joshi, Katy, TX (US); Dewey L. Parkey, Jr., Magnolia, TX (US); Naresh Sundaram Iyer, Ballston Spa, NY (US); Nurali Virani, Niskayuna, NY (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 647 days.

(21) Appl. No.: 16/433,953

(22) Filed: Jun. 6, 2019

(65) Prior Publication Data

US 2020/0386093 A1 Dec. 10, 2020

(51) Int. Cl.
*E21B 47/11* (2012.01)

(52) U.S. Cl.
CPC ..... *E21B 47/11* (2020.05); *E21B 2200/20* (2020.05); *E21B 2200/22* (2020.05)

(58) Field of Classification Search
CPC ..... E21B 47/11; E21B 47/10; E21B 47/00; E21B 2200/20; E21B 2200/22; E21B 2200/00; E21B 47/107; E21B 43/305; E21B 43/30; E21B 43/00
See application file for complete search history.

(56) References Cited

U.S. PATENT DOCUMENTS 3,532,968 A1 9/2013 Oury et al.
2017/0002630 A1 * 1/2017 Priezzhev ..... G06F 16/245
(Continued)

FOREIGN PATENT DOCUMENTS

WO WO-2017035370 A1 * 3/2017 ..... E21B 47/10

OTHER PUBLICATIONS

Dongbo, et al.; "Well Type and Pattern Optimization Technology for Large Scale Tight Sand Gas, Sulige Gas Field, NW China"; Feb. 2013; vol. 40, Issue 1; Petroleum Exploration and Development; 12 pages.

(Continued)

*Primary Examiner* — Mohamed Charioui
(74) *Attorney, Agent, or Firm* — Cantor Colburn LLP

(57) ABSTRACT

A method for determining a location and trajectory for a new wellbore relative to an adjacent wellbore includes: receiving controllable variable data and uncontrollable variable data related to fracturing a formation by a stimulation operation in a first wellbore penetrating the formation; receiving pressure communication event or pressure non-communication event identification data related to identification of a pressure communication event or pressure non-communication event in a second wellbore penetrating the formation in response to the fracturing; extracting features from the controllable and uncontrollable variable data to provide extracted features; detecting a pressure communication (Continued)

event using the extracted features and the pressure communication event or pressure non-communication event identification data using an analytic technique; identifying one or more quantified causes of the detected pressure communication event using an artificial intelligence technique; and determining the location and trajectory of the new wellbore using the one or more quantified causes.

17 Claims, 12 Drawing Sheets

(56) References Cited

U.S. PATENT DOCUMENTS

2017/0096880 A1 4/2017 Ben et al.
2017/0364795 A1* 12/2017 Anderson ..... G06N 20/10
2018/0240021 A1 8/2018 Al-Harbi et al.
2018/0284311 A1 10/2018 Echeverria Ciaurri et al.
2020/0284127 A1* 9/2020 Ismail ..... G06F 30/20

OTHER PUBLICATIONS

Klenner et al. "Characterization of Fracture-Driven Interference and the Application of Machine Learning to Improve Operational Efficiency", SPE-191789-MS; 2018; Society of Petroleum Engineers; 13 pages.
Lehmann, et al.; "Expanding Interpretation of Interwell Connectivity and Reservoir Complexity through Pressure Hit Analysis and Microseismic Integration"; SPE-179173-MS; 2016; Society of Petroleum Engineers; 20 pages.
Xu, et al.; "Advanced Modeling of Production Induced Pressure Depletion and Well Spacing Impact on Infill Wells in Spraberry, Pemian Basin"; SPE-191696-MS, 2018, Society of Petroleum Engineers, 17 pages.

* cited by examiner

FIG. 2A
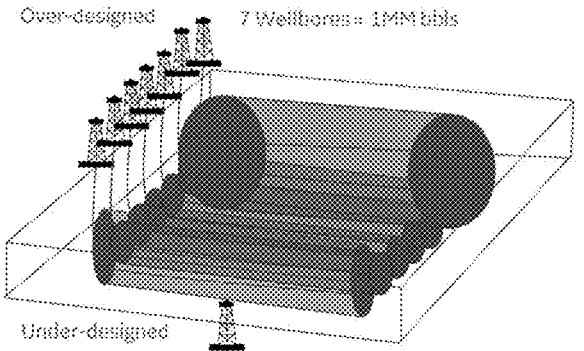
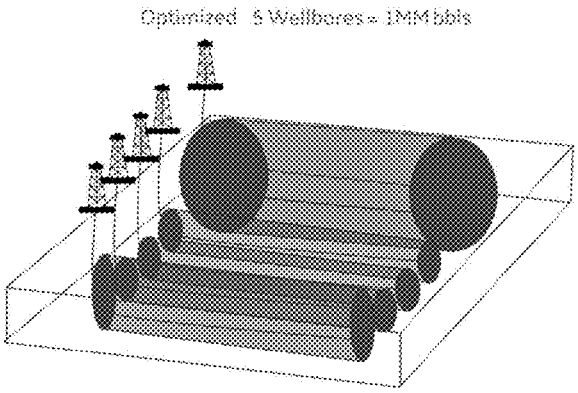
FIG. 2C
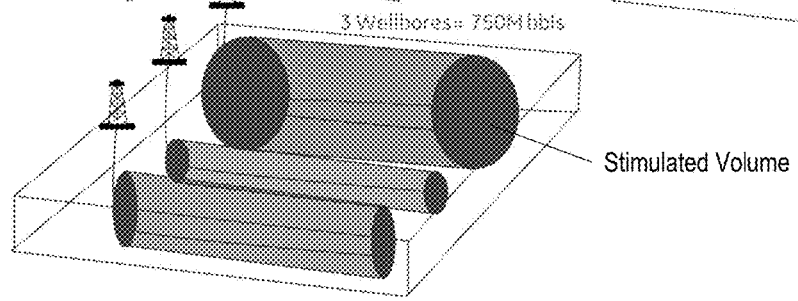
FIG. 2B

PROCESS FOR INFILL WELL DEVELOPMENT IN A SUBSURFACE RESERVOIR

BACKGROUND

Boreholes or wellbores are drilled into subsurface geologic formations that contain reservoirs of hydrocarbons in order to extract the hydrocarbons. Typically, a first set of wellbores are distributed over an area that is believed to define the boundaries of a reservoir block, or an operator's interest in the reservoir block. These parent wellbores generally have a horizontal component that extends into the reservoir. A second set of wellbores may be drilled beside the parent wellbores to increase the production of hydrocarbons and fully exploit the reservoir asset. The second set of wellbores may be referred to as infill wellbores.

Horizontal infill development is a common practice in tight oil basins. The conventional technique for infill development includes a repeatable geometric process or uniform approach that includes a constant vertical and lateral spacing of the infill wellbores throughout the area. However, the uniform approach can result in too many wellbores being drilled with the associated cost or poor production from the parent wells and/or the infill wells due to multiple reasons. Hence, innovations that identify a unique development design to minimize the number of infill wells required to maximize production and profit from the reservoir block would be well received in the drilling and production industries.

BRIEF SUMMARY

Disclosed is a method for determining a location and trajectory for a new wellbore relative to an adjacent wellbore. The method includes: receiving, with a processor, controllable variable data related to fracturing a formation by a stimulation operation in a first wellbore penetrating the formation; receiving, with the processor, uncontrollable variable data related to the fracturing; receiving, with the processor, pressure communication event or pressure non-communication event identification data related to identification of a pressure communication event or pressure non-communication event in a second wellbore penetrating the formation in response to the fracturing by the stimulation operation in the first wellbore; extracting, with the processor, features from the controllable variable data and the uncontrollable variable data to provide extracted features; detecting, with the processor by use of an analytic technique, a pressure communication event using the extracted features and the pressure communication event or pressure non-communication event identification data; identifying, with the processor by use of an artificial intelligence technique, one or more quantified causes of the detected pressure communication event; and determining the location and trajectory of the new wellbore using the one or more quantified causes.

Also disclosed is a system for determining a location and trajectory for an infill wellbore relative to an adjacent wellbore. The system includes: a stimulation apparatus configured for fracturing a formation through a first wellbore penetrating the formation; a sensor disposed in a second wellbore penetrating the formation and configured to acquire sensed data related to pressure communication or pressure non-communication between the first wellbore and the second wellbore due to the fracturing; and a processor. The processor is configured for: receiving controllable variable data related to the fracturing; receiving uncontrollable variable data related to the fracturing; receiving pressure communication event or pressure non-communication event identification data related to identification of a pressure communication event or pressure non-communication event in the second wellbore in response to the fracturing; extracting features from the controllable variable data and the uncontrollable variable data to provide extracted features; detecting, by use of an analytic technique, a pressure communication event using the extracted features and the pressure communication event or pressure non-communication event identification data; identifying, by use of the artificial intelligence technique, one or more quantified causes of the detected pressure communication event; and determining the location and trajectory of the new wellbore using the one or more quantified causes.

BRIEF DESCRIPTION OF THE DRAWINGS

The following descriptions should not be considered limiting in any way.

With reference to the accompanying drawings, like elements are numbered alike:

FIGS. 2A-2C, collectively referred to as FIG. 2, depict aspects of an over-designed well system, an under-designed well system, and an optimized well system;

DETAILED DESCRIPTION

A detailed description of one or more embodiments of the disclosed apparatus and method are presented herein by way of exemplification and not limitation with reference to the Figures.

Disclosed are methods and systems for determining placement of infill wells and/or other types of new wells to be drilled. The term "infill wells" as discussed below is intended to be inclusive of the other types of new wells to be drilled. The term "placement" is inclusive of location and trajectory of the infill wells. The placement of the infill wells is configured to minimize the number of infill wells required while maximizing the production of hydrocarbons from all the wells in the reservoir block and, thus, maximizing profit. The number of infill wells is minimized by placing wells as far apart as possible or within a desired range such that a stimulated volume of each infill well does not communicate through fluid advection of pressure transients with a stimulated volume of an adjacent well. Certain types of information and data are obtained from a first set of wells (i.e., parent wells) and a second set of wells to be drilled (i.e., infill wells) installed in the reservoir block. Using descriptive analytics that include machine learning and artificial intelligence, the information and data are processed to provide quantifiable attributes or explainers of the parent wells that are used to place the infill wells. The infill wells (i.e., the second set of wells) may then be placed and drilled based upon the quantifiable explainers.

Figure 1:
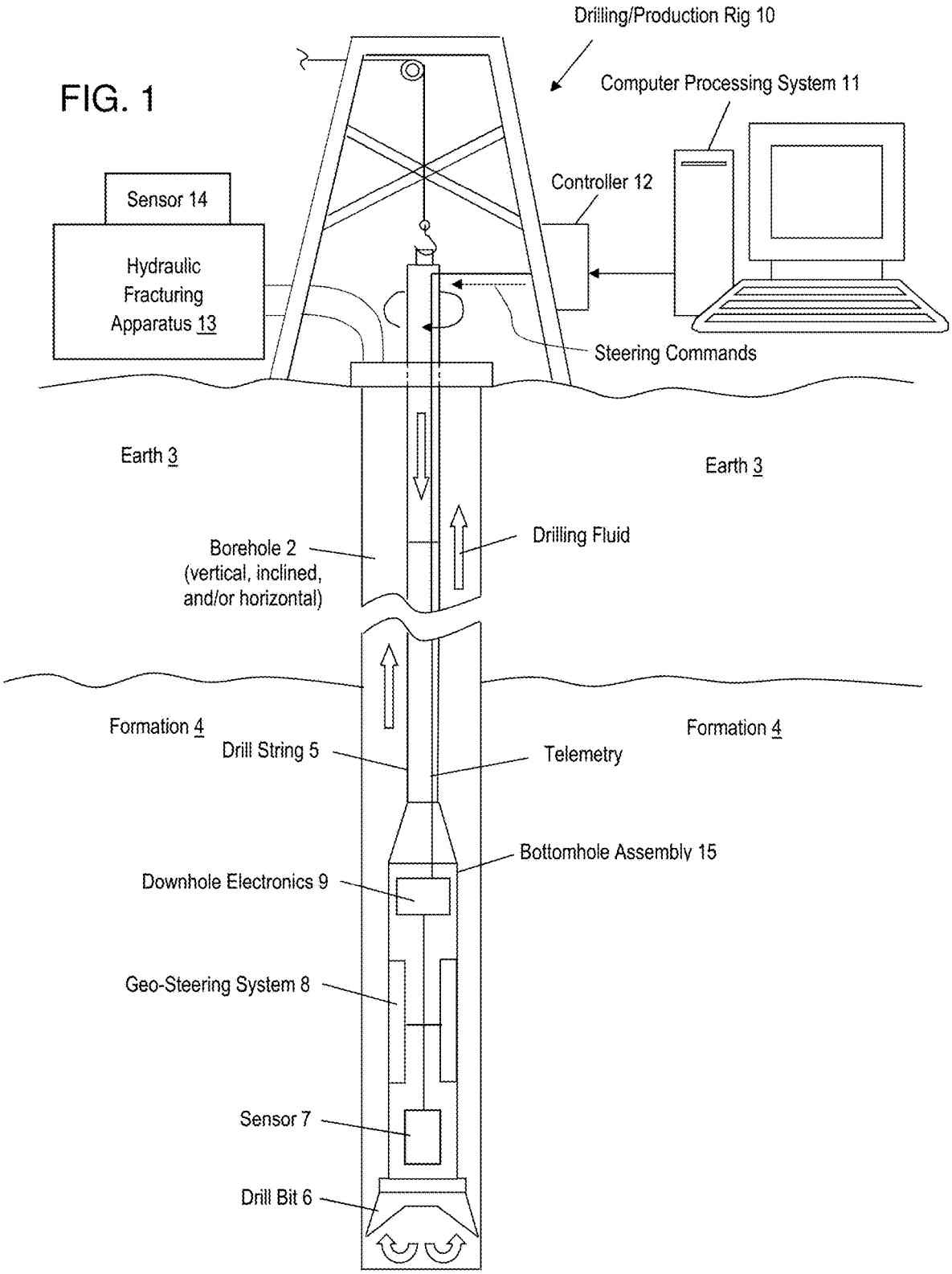
FIG. 1 illustrates a cross-sectional view of a drill and/or production rig for drilling a wellbore penetrating a subsurface formation or stimulating the subsurface formation.

Apparatus for implementing the disclosed methods is now discussed. FIG. 1 is a cross-sectional view of a borehole 2 (may also be referred to as a wellbore or well) penetrating the earth 3, which includes a formation 4. The formation 4 includes a reservoir of hydrocarbons, which can be oil, gas or combination thereof. The borehole 2 can be vertical, as illustrated, inclined, and/or horizontal. A drilling/production rig 10 is configured to drill the borehole 2, stimulate the formation 4 for hydrocarbon production, run mechanical wellbore completion (e.g., install casing, tubing packers, sleeves) for hydrocarbon production, and/or extract hydrocarbons from the formation 4 via the borehole 2. The drilling/production rig 10 may also be configured to implement completion designs, which can include stages, spacing, and perforations at specified locations as non-limiting embodiments. A drill bit 6 is disposed at the distal end of a drill tubular 5 for drilling the borehole 2. The drill tubular 5 may be a drill string made up of a plurality of connected drill pipes or the drill tubular 5 may be coiled tubing. Drilling fluid or mud is pumped through the drill tubular 5 to lubricate the drill bit 6 and flush cuttings from the borehole 2. A drilling/production parameter controller 12 is configured to control, such as by feedback control for example, parameters of oilfield equipment used to drill the borehole 2, stimulate the formation 4, and/or extract hydrocarbons via the borehole 2. Control setpoints or parameters may be transmitted to the drilling/production parameter controller 12 by a computer processing system 11.

The drill tubular 5 includes a bottomhole assembly (BHA) 15. The BHA 15 includes a downhole sensor 7 configured for sensing various downhole properties or parameters related to the formation 4, the borehole 2, and/or position, orientation or location of the BHA 15. Sensor data may be transmitted to the surface by telemetry for processing such as by the computer processing system 11. Sensed data may be correlated to a depth at which the data was sensed to provide a log, which may be stored in the computer processing system 11. The BHA 15 may also include a geo-steering system 8. The geo-steering system 8 is configured to steer the drill bit 6 in order to drill the borehole 2 according to a selected path, geometry, or trajectory. The path, geometry or trajectory in general is selected in accordance with the methods disclosed herein for placement of infill wells. Steering commands may be transmitted from the drilling/production parameter controller 12 to the geo-steering system 8 by the telemetry. The sensor 7 may provide position, orientation and/or location information to the control 12 for steering the drill bit 6. In addition or alternatively, the sensor 7 may be a geophone to detect seismic data (e.g., seismic or micro-seismic events) or a chemical detector to detect a tracer chemical injected in a wellbore adjacent to another wellbore that was used to hydraulically fracture the formation 4.

The telemetry in one or more embodiments may include mud-pulse telemetry or wired drill pipe. Downhole electronics 9 may process data downhole and/or act as an interface with the telemetry.

The drill/production rig 10 further includes a formation stimulation system 13 configured to stimulate the formation 4 to increase the extraction rate of hydrocarbons. In one or more embodiments, the formation stimulation system 13 is configured to hydraulically fracture the formation 4 using a fracking fluid. The drilling/production parameter controller 12 is configured to control parameters of the formation stimulation system 13 such as hydraulic fluid flow rate, hydraulic fracturing pressure, injection volume, and location and placement of packers. Setpoints and control information for controlling parameters of the formation stimulation system 13 may be obtained from the computer processing system 11.

The drill/production rig 10 further includes the horsepower (i.e., motors) and equipment configured to run various downhole equipment (e.g., tubulars, packers, sleeves and other components) for mechanical wellbore completion and production oilfield equipment configured for production of hydrocarbons via the borehole 2. In one or more embodiments, the production oilfield equipment includes one or more pumps and valves (not shown) configured to pump and control flow of hydrocarbons from the borehole 2. The drilling/production parameter controller 12 is configured to control production parameters such a pump speed and valve position.

FIG. 2 depicts aspects of various infill well design conditions. FIG. 2A depicts an over-designed condition where seven wellbores produce 1 mM bbls of oil. FIG. 2B depicts an under-designed condition where three wellbores produce only 750 mM bbls of oil. FIG. 2C depicts an optimized condition where five wellbores produce 1 mM bbls of oil. The embodiment of FIG. 2C represents an improvement over the embodiment of FIG. 2A because only five wellbores are needed to produce the same amount of oil as that produced by the seven wellbores in the embodiment of FIG. 2A.

Figure 3:
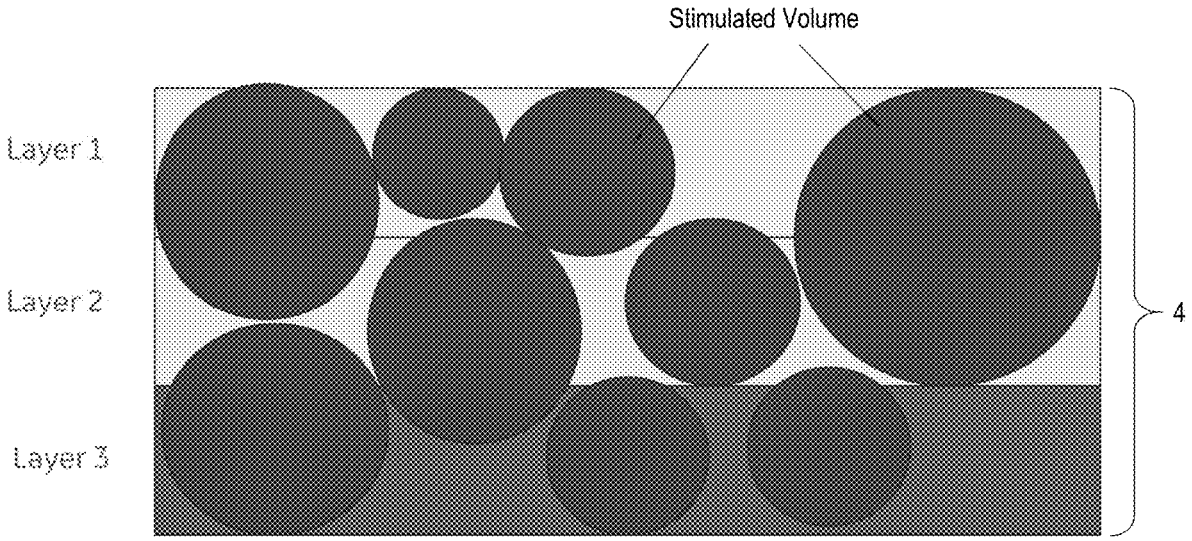
FIG. 3 depicts aspects of horizontal wells in a multi-layer scenario.

FIG. 3 depicts aspects of horizontal wells in a multi-layer scenario that optimizes reservoir production. As can be seen, the stimulated volumes of the wellbores are spaced closely together and may actually slightly intersect an adjacent stimulated volume. This scenario avoids greatly overlapping of adjacent stimulated volumes.

Figure 4:
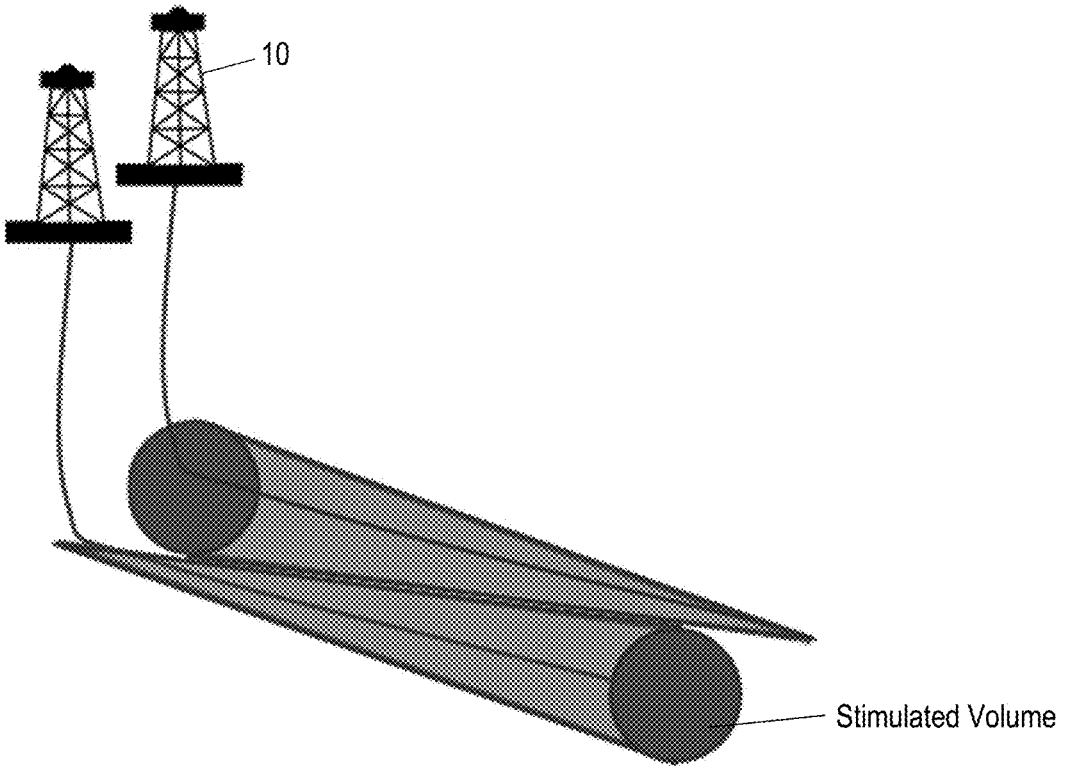
FIG. 4 depicts aspects of an example of complementary non-cylindrical stimulated or drained volume shapes.

FIG. 4 depicts aspects of an example of complementary non-cylindrical stimulated or drained volume shapes. In the embodiment of FIG. 4, the stimulated volumes are non-cylindrical, but conical. Here, the conical shapes have a complementary configuration where overlapping stimulated volumes are avoided or minimized. Stimulated volumes may have other types of non-cylindrical shapes. Complementary shapes may be achieved by controlled stimulation along the wellbore in various stimulation stages isolated by packers.

Figure 5:
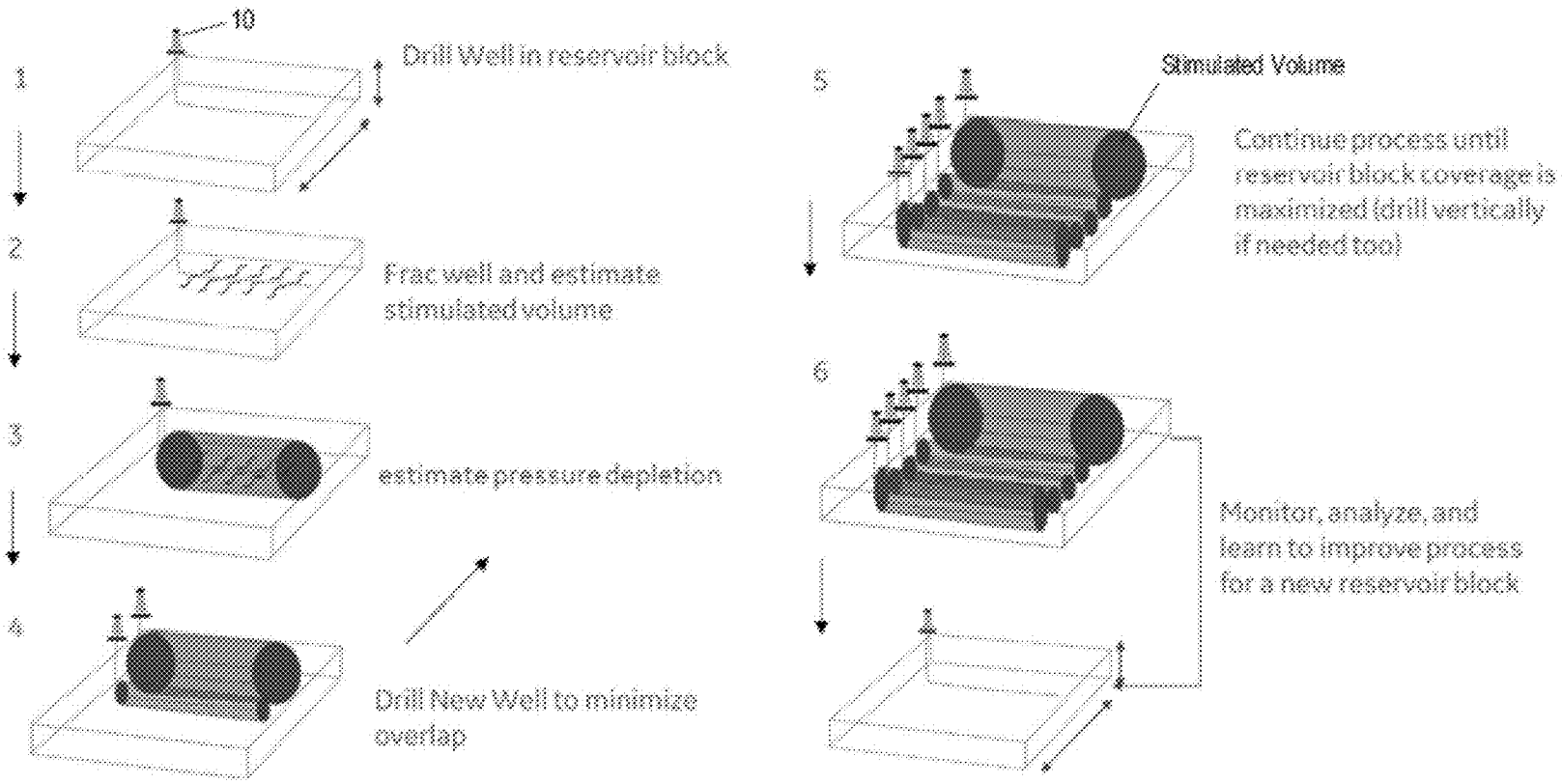
FIG. 5 depicts aspects of learning from drilling wells in a current reservoir block to improve a process for drilling wells in a new reservoir block.

FIG. 5 depicts aspects of learning from drilling wells in a current reservoir block to improve a process for drilling wells in a new reservoir block. In a first stage, a wellbore is drilled into a current reservoir block. In a second stage, the wellbore is hydraulically fractured and a stimulated volume is estimated based on parameters of the hydraulic fracturing such as fracturing pressure, fracturing fluid flow rate, and lithology of the reservoir in a non-limiting example. In a third stage, pressure depletion in the stimulated volume is estimated. In a fourth stage, a new wellbore is drilled in a placement that minimizes or prevents overlap of a stimulated volume of the new wellbore with the stimulated volume of the previously drilled wellbore. In a fifth stage, the process of drilling new infill wellbores is continued where the new infill wellbores are placed to minimize or prevent overlap of the corresponding stimulated volumes.

The stimulated volumes of the new infill wellbores may be placed horizontally, vertically, and/or diagonally with respect to each other in order to maximize coverage of the current reservoir block. In a sixth stage, characteristics of each wellbore are monitored to produce various types of well data and this data is analyzed to learn how to improve the process of drilling infill wells in a new reservoir block. In one or more embodiments, sensors may be used to monitor the characteristics of each wellbore. Non-limiting embodiments of the wellbore characteristics include depletion pressure over time and oil production flow rate over time. Other characteristics may also be sensed. In one or more embodiments, analysis of the various types of well data include using artificial intelligence and/or machine learning to develop correlations between various variables associated with each well and between wells. Based on these correlations the number of infill wells and their placement can be determined to optimize production and minimize cost.

Figure 6:
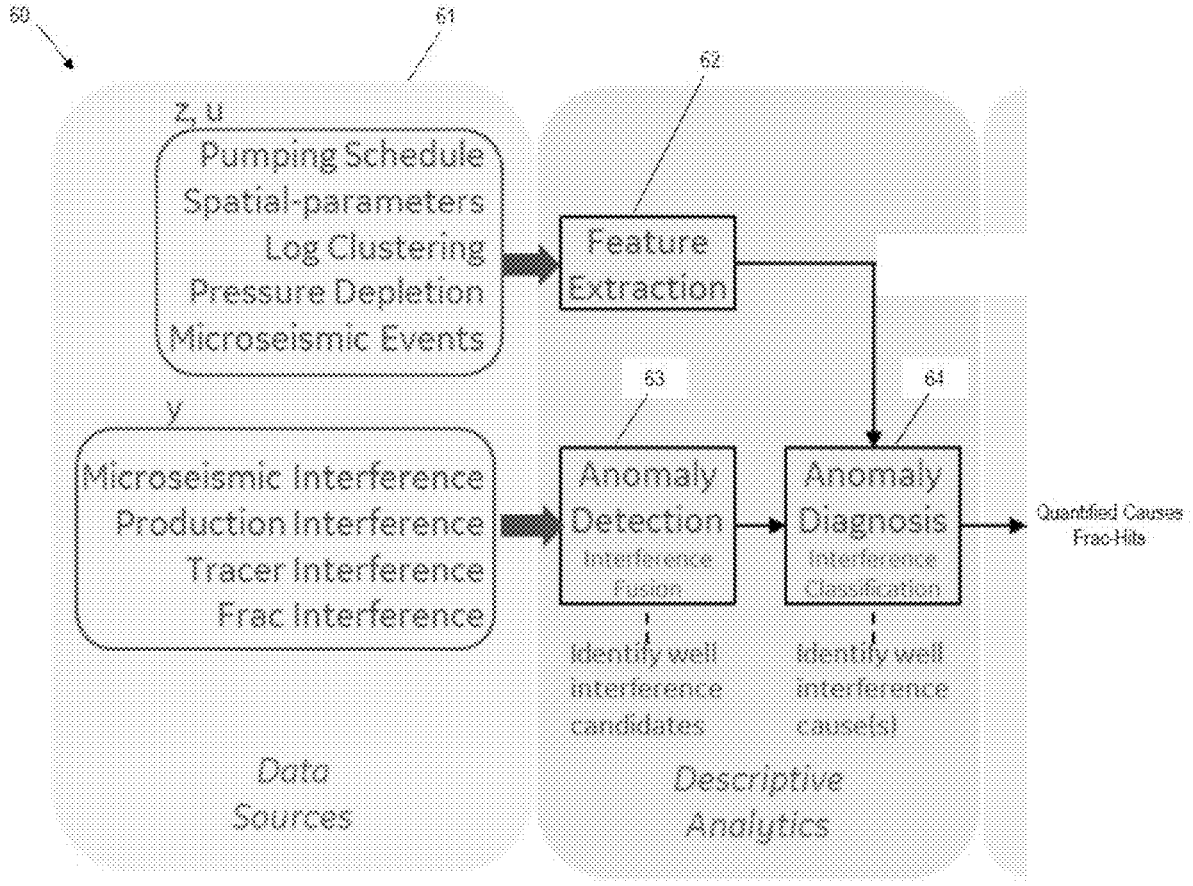
FIG. 6 depicts aspects of one embodiment of a workflow to obtain parameters for placement of infill wells.

FIG. 6 depicts aspects of one embodiment of a workflow 60 for obtaining parameters for placement of infill wells. Block 61 calls for obtaining raw (i.e., unprocessed) data from various data sources. "z" data refers to raw operational control variables that a user has control over. Non-limiting embodiments of the z-data include pumping schedule, spatial-parameters, wellbore undulation, well alignment, and hydraulic fracturing designs and/or treatments. The pumping schedule details all of the features and timing of a completion job. This includes injection rates, stage volumes, injection times, fluid types, proppant types and volumes and friction factors per stage per well. Spatial parameters include well spacing, well deviation, northing/easting, total vertical depth, azimuth, and inclination of wellbore. Wellbore undulation relates to the change in vertical placement of the wellbore along its length. Well alignment relates to straightness and true location of a well when compared to planned location. "u" data refers to uncontrollable variables from operations for drilling new wells. Non-limiting embodiments of the u-data include pressure depletion for drilled new wells, regional and natural fracture patterns, in situ stresses, fracture barriers, microseismic events. Pressure depletion is the difference from initial reservoir pressure to current reservoir pressure at infill drilling date. Regional and natural fracture patterns refers to cracks and fractures existing in source rock previous to hydraulic fracturing. In situ stresses relates to stresses subjected on source rock from natural causes—weight of overlying strata, tectonic conditions, etc. Fracture barriers relate to anything that would prohibit hydraulic fracturing from being efficient such as insitu stresses and regional and natural fracture patterns. Microseismic logs track the formation of fractures; this tracking can indicate where fractures go and what area(s) are more susceptible to fracture driven interference or frac-hits. "y" data are raw interference data that provides information for identifying when pressure communication occurs or not between two wells. This type of pressure communication may be referred to as "fracture driven interference" or "frac-hits." The z and u-data are used to explain why frac-hits are occurring. This type of data can include any number of variables. Non-limiting embodiments of z and u-data include pumping schedule, hydraulic fracturing treating pressures, slurry rates, spatial parameters such as well spacing and stage length, other hydraulic fracturing designs and/or treatments such as a number of clusters per stage and perforation concentrations, and pressure depletion around parent wells. Non-limiting embodiments of the y-data include micro-seismic images, production logs, tracers, and offset pressure during hydraulic fracturing. Production logs can be used to evaluate fluid production and movement through a well bore. Tracers are material put into fracture fluid that, if found in an offset well's production, indicates communication paths. Offset pressure during hydraulic fracturing is time series pressure of offset wells with high enough resolution that sudden changes can be captured and analyzed. These types of data can indicate inter-well communication has occurred based on a change in behavior of this data (e.g., a sharp increase in pressure in the offset pressure data). In one or more embodiments, y-data is data obtained during active stimulation with passive monitoring of offset pressure sensors.

Block 62 calls for extracting features from the raw operational control variable data and the raw uncontrollable variable data to provide extracted features. Feature extraction is used to extract features from raw data, such as by conditioning it or performing calculations using it, to make it useable for implementing machine learning algorithms. Feature extraction in one or more non-limiting embodiments includes calculating nearest offset distances, pressure depletion, and finding maximum and average rates and/or pressures from completion data. In one or more embodiments, conditioning of the raw data or calculations using the raw data may not be necessary to extract features in that the features may be readily observable in the raw data.

Feature extraction extracts information from the other available data types for the machine-learning classification analysis discussed below. Data types include well logs, production, structural surfaces, deviation surveys, etc. Although these data types could be accessed and analyzed independently as raw data, such analysis may not provide direct and timely insights for guiding an adjustment in the field. Feature extraction produces tangible outputs from the machine-learning diagnosis, informing a modification in the completion design or enabling better placement of subsequent wellbores. Features may be extracted into two categories, and they can be broken down at the well level or the stage level, as shown in TABLE 1. An additional benefit of this approach is that continuous anomaly detection and feature extraction from additional well pads will further improve the quality of the analytics.

TABLE 1

| Controllable (Operations) | Uncontrollable (Subsurface) |
|---|---|
| Total bbl of Fluid | Average Gamma |
| Max Treatment Pressure | Average Rate-of-Penetration |
| Max Treatment Rate | Distances to Fracture Barriers |
| Avg. Treatment Rate | Formation or Zone |
| Avg. Treatment Pressure | Reservoir Pressure (Radius) |
| Avg. Proppant Concentration | Natural Fracture Identification |
| Total lbs. of Proppant | Fault Distances |
| Proppant Type | Fracture Gradient |
| Fluid Type | |
| Number of Perforation Shots | |
| Number of Perforation Clusters | |
| Perforation Density | |
| Offset Distance | |

After the features are extracted, a correlation analysis is conducted. The correlation analysis identifies variables with strong negative or positive correlation. A threshold can then be applied to the correlation coefficient. If two variables are highly correlated based on the threshold, users can select the variable they would like to choose in the analysis. For example, a user may select a variable that provides the most insight to the problem at hand and enables operational implementation. With regards to Controllable Features in Table 1, Total bbl of Fluid relates to total fluid pumped into wellbore during hydraulic fracturing in bbls. Maximum Treatment Pressure relates to maximum value of treating pressure (see hydraulic fracturing treating pressures below). Maximum Treatment Rate relates to maximum value of slurry rate (see slurry rate below). Average Treatment Rate relates to average value of slurry rate. Average Treatment Pressure relates to average value of treating pressure. Average Proppant Concentration relates to average value of proppant concentration being pumped into stage. Total lbs. of Proppant relates to total fluid pumped into wellbore during hydraulic fracturing in lbs. Proppant Type relates to type of proppant being used in hydraulic fracturing—examples include sand, 100 mesh, 40/70, etc. Fluid Type relates to fluid type being mixed with proppant to create slurry, examples include slickwater, linear gels, surfactants, etc. Number of Perforation Shots relates to number of holes perforated in casing lining wellbore in each stage of hydraulic fracturing job. Number of Perforation Clusters relates to number of perforations in a cluster of perforations. Perforation Density relates to number of perforations per lateral foot. Offset Distance relates to distance between two wells. Hydraulic fracturing treatment pressures relates to pressure at which hydraulic fracturing fluid is entering the reservoir. Slurry rate relates to the injection rate of volume of slurry per time; slurry being the mixture in which solids are suspended in a liquid. With regards to uncontrollable features in Table 1, average gamma is an average value of detected gamma rays.

Block 63 calls for performing anomaly detection using the raw interference data to provide detected anomalies. Here, anomalies refer to fracture driven interference events or frac-hits. In one or more embodiments, the detected anomalies include identification of the specific two wellbores that had the pressure communication and the data that indicated each of the anomalies. Anomaly detection is a process that allows identifying if frac-hits/communication has occurred based on the data in the raw interference data set. In a non-limiting example, a significant pressure spike in a parent wellbore as indicated in the raw interference data would indicate that a frac-hit has occurred.

In one or more embodiments, anomaly detection takes the form of a detectable increase in the surface or bottomhole pressure during an offset frac. Anomaly detection can be tedious to process multiple fracture stages or multiple wells of data types manually, due to the volume of data collected as well as the varying timescales of data collection. Consequently, conventional analysis typically occurs sometime after the well pad has been drilled out and completed. Furthermore, data cleansing can often be the greatest challenge prior to the start of any analysis. Consequently, analytics as disclosed herein is used to enable automated analysis in real-time, near real time. The method also enables analysis of datasets that are too large to be analyzed manually. This analysis then enables derivation of insights rapidly and in time to mitigate interference from an operational sense and to prevent it from occurring in the future. Observations from the different data types can be a binary label (an observation occurred or did not occur) when analyzing tracer, production, and microseismic data. Other characteristics about the label may provide additional value when performing predictive analytics.

One data type for the classification analysis is the use of the active frac and passive offset pressure monitoring. Anomalies can be detected at the stage level during the offset active stimulation with the corresponding passive pressure monitoring data. The pressure versus time curve includes four easily identifiable characteristics that can be used to detect anomalies. (1) Time delay: The time difference between when a pressure hit starts and the start of the offset hydraulic fracturing. (2) Intensity: The positive slope showing an increase of the pressure response until the peak of the pressure event. (3) Magnitude: The peak pressure value observed in response to offset stimulation. (4) Falloff: The negative slope showing a decrease of the pressure after the peak pressure was observed. Other analytic techniques may also be used.

The analytics, such as those discussed above for example, may be used to detect anomalies in the monitoring well pressure data. As an example, the analytics detect sequences of increasing values of measured pressure. This detection enables thresholds to be applied when running the analytic, either as minimum increases in pressure per unit time or as a minimum number of consecutive increasing measurements. The thresholds eliminate noise or tune the analysis based on play or region.

After the anomalies are detected and the characteristics calculated, the responses are given the binary label, denoting that a pressure response has occurred or has not occurred. This label enables the machine learning to understand what is labeled as an interference event and what is not. Furthermore, not all events are identical, which can be attributed to the characteristics based on intensity or magnitude. Anomaly events may be categorized into three different types, which can be used for detection or for feature extraction discussed above in block 62. (1) Fracture Shadowing: Minor pressure increases in the shut-in well causing production impacts to be delayed or to have a minor impact. (2) Temporary fracture-to-fracture communication: The pressure increases are only tens to hundreds of psi and stop after the end of pumping the active stage and return to pre-pumping levels after a short period of time. Production impacts (losses or gains) can be expected to be minor or delayed. (3) Long-term fracture-to-fracture communication: Pressure communication lasts beyond the pumping of each stage, and the production impact is usually quick and may be long-term or permanent.

Block 64 calls for performing anomaly diagnosis using the extracted features and the detected anomalies to provide quantified explainers or causes that include quantified values of features that cause the anomalies to occur. For example, anomaly diagnosis takes all of the features extracted from the z,u-data and well as the anomaly detection data and provides quantified explainers for why the anomalies occurred. As an example, well spacing of less than 500 feet may have been correlated to frac-hits occurring using a machine learning algorithm to develop correlations. In one or more embodiments, the machine learning algorithm includes an ensemble-based random forest classifier to determine which features were common amongst stages that caused frac-hits and what value of these features specifically caused the frac-hits to occur.

In anomaly diagnosis, observations are the anomalies detected or interference observed and the symptoms are the features listed in TABLE 1. In machine learning, classification is a category of supervised learning, whereby existing observations are used to learn patterns that map multivariate features to a set of known categories or labels. Classification analysis involves building a machine-learning model called a "classifier" that discovers the complex mathematical relationship linking observation properties to the likelihood of a label by analyzing large volumes of recorded observations for which both the properties and labels are known. For example, in the case of diagnosis of a medical ailment, the symptoms, the patient's medical history, and the outcomes from medical tests are all relevant properties that can help map the patient's state to a specific disease (label). Alternate versions of the classification problem where the labels are non-binary have also been considered, with the label capturing the number of communication events that can be associated with an in-progress stage. In each case, the classifier learns a complex, multivariate relationship between the stage-specific features and its label. To validate that the functional relationship the classifier is learning is robust and generalizable, cross-validation techniques (k-fold CV) are used while building the classifier.

The objective in applying machine learning is to enable a continuous learning-based analysis using the results of the interference analysis and features extracted from multiple wells. As a larger database of interference observations is analyzed, this will improve understanding and analysis. Like the medical example above, we can improve our understanding and prescribe medications or understand the extremes the more patients' data is made available to a diagnosis. By using this technique for analyzing well interference, different classification experiments can be performed as the sample population grows. For example, at times a user may only want to analyze wells that are closest to the depleted parents and separate them from the sample population. As the sample population and dataset grow, the value of gathering certain data to perform the diagnosis or to gather additional data types to extract new features can be seen. This perception will ultimately help a user understand cost trade-offs when collecting data in the field based on the additional insights they will provide.

Based on the information available, different experiments were set up for the classification analysis. This included two different well sets (all infills, depleted infills), two interference sets (frac, tracer data and frac), and one feature set. For each experiment, the correlation and variable importance was performed prior to the classification analysis. The analysis would then split and create rules that were robust or help the user understand why an active stage caused a pressure hit at an offset. The rules would split at a quantified value and build upon themselves in an if-else argument, providing robust insights. These insights can now provide quantitative cutoffs for operational awareness for future mitigation or understanding of why interference is occurring.

Figure 7:
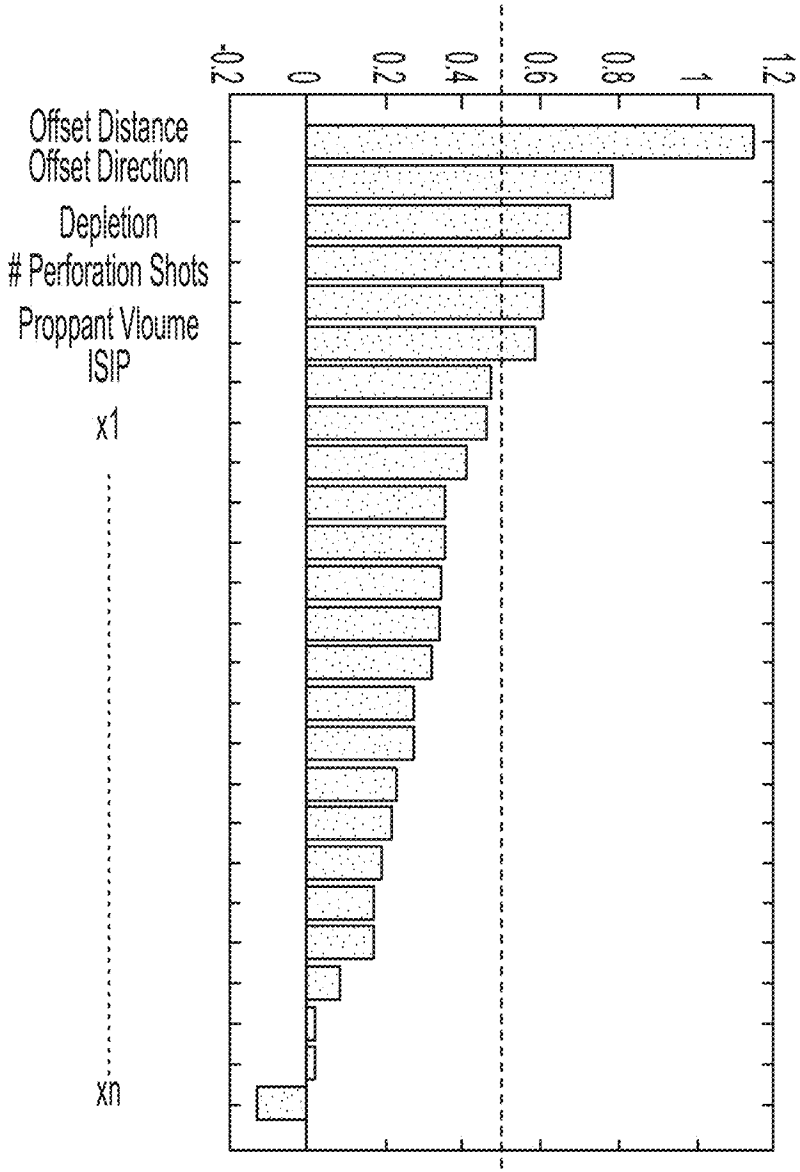
FIG. 7 depicts aspects of variable importance ranking for classification analysis.

The classifier can be used to provide multiple forms of insights. For example, based on the historical data, it can rank all the input variables (stage properties) in their order of importance to help accurately identify the stage-label, thereby giving insights into the strongest operational drivers that could be precipitating the well communication events as illustrated in FIG. 7. FIG. 7 depicts aspects of variable importance ranking for classification analysis. At a more specific level, the classifier data can be further analyzed using an 'insight engine', to glean interpretable rules and statements describing the conditions that tend to lead to well communication events. The latter step is valuable because traditional machine-learning classifiers tend to be black-box, wherein the underlying complex relationship between the observation properties and its label are almost impossible to interpret by a human. The insight engine breaks down this opacity of the classifier and extracts human-readable rules that explain well communication.

Figure 8:
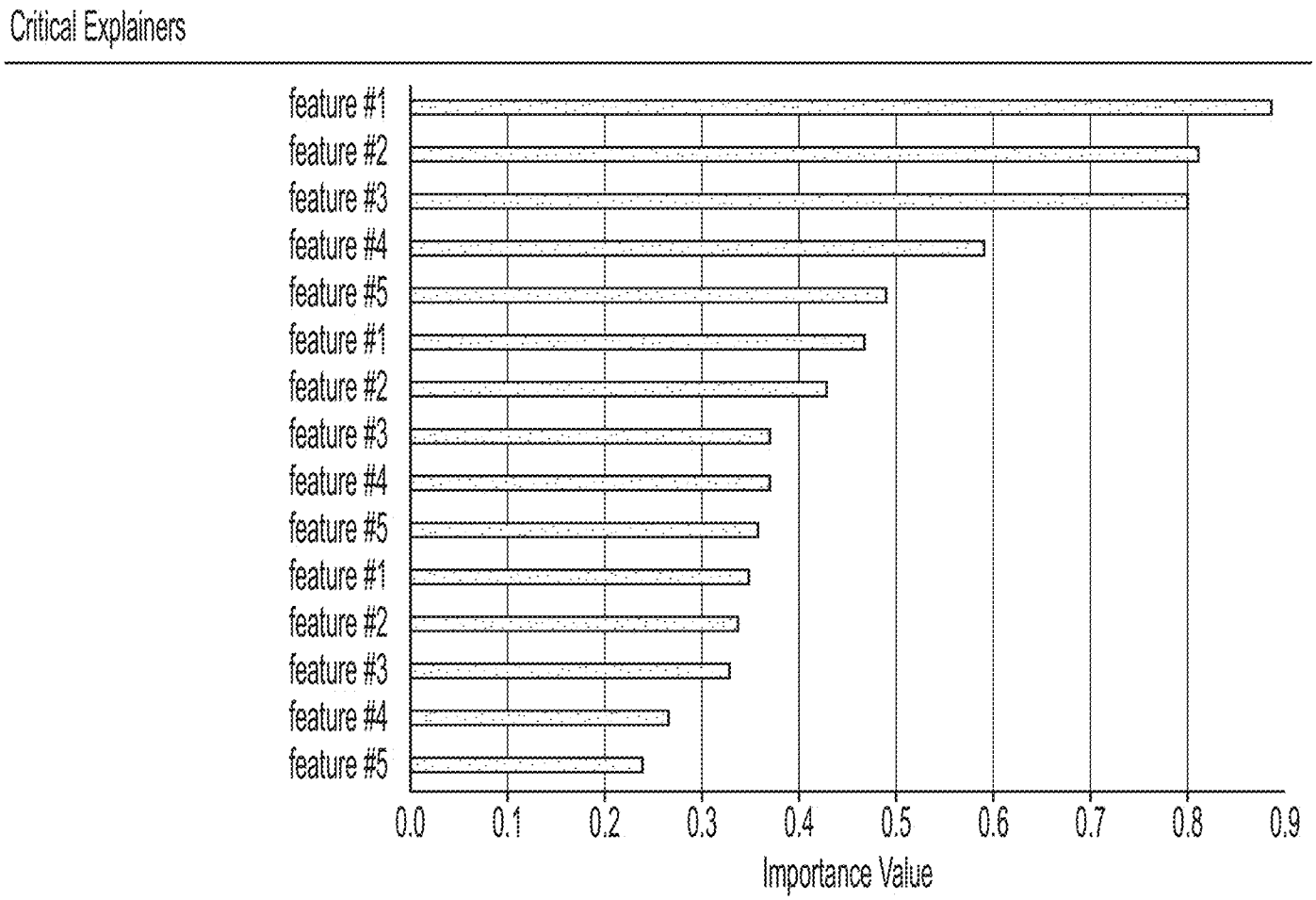
FIG. 8 depicts aspects of an insight engine.
Figure 8:
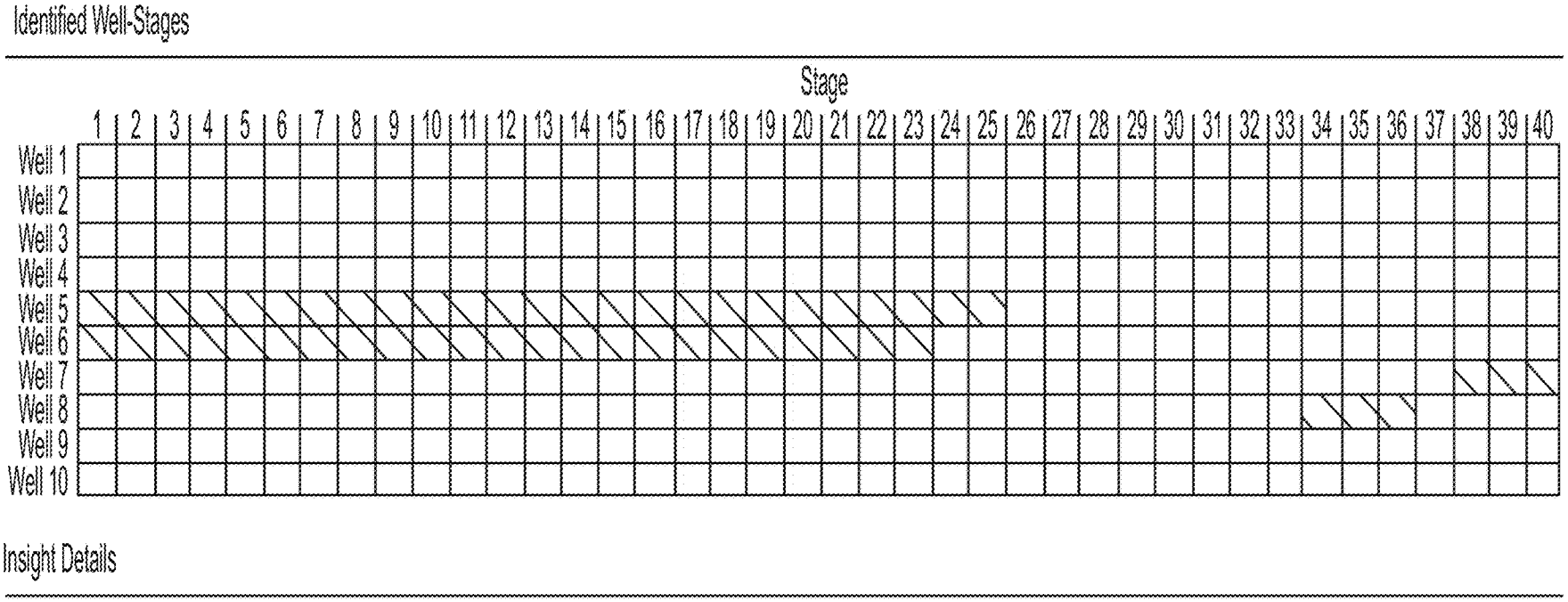

In one instance, an ensemble-based random forests classifier was used, which was composed of hundreds of diverse decision trees, each trying to estimate the best set of rules that map properties to label. This instance produced around 14,000 complex rules, each of which made use of different subsets of observation-properties to try and accurately infer the labels for a subset of observations. These rules were diverse in terms of the number of observations they tackled (rule size), the number of variables the rule is composed of (rule simplicity), or the fraction of observations they tackled (rule coverage). The insight engine helps a user sift through this large, complex rule base and break down the rules into human-readable (both text and visual) content that helps crystallize the broader associations from observation-properties to observation-labels that seem to dominate the overall classification model. An example of the insight engine is illustrated in FIG. 8, where the end-user can interact with the complex classifier by specifying his/her preferences for viewing insights.

Figure 9:
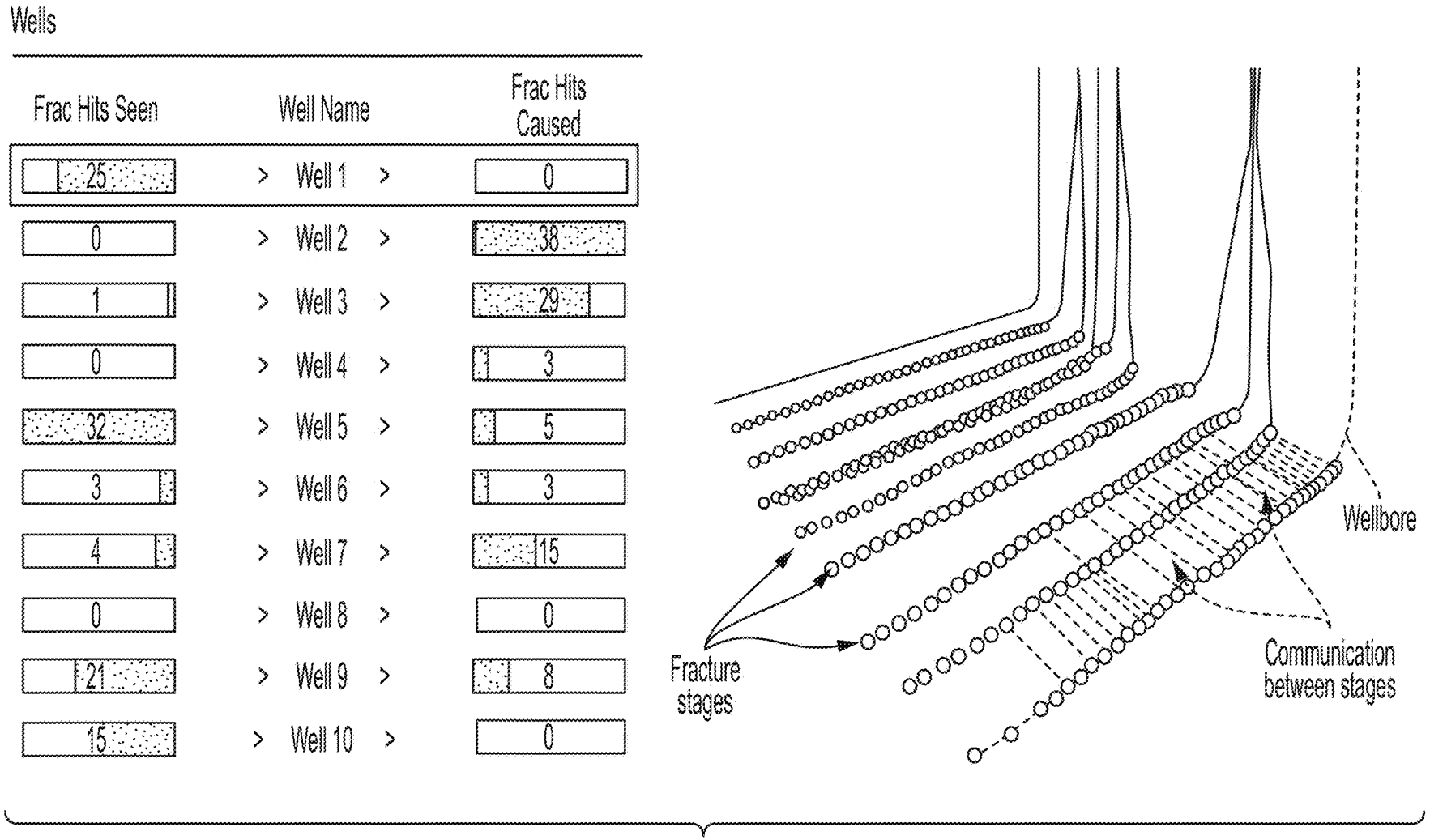
FIG. 9 displays results of the insight engine.
Figure 10:
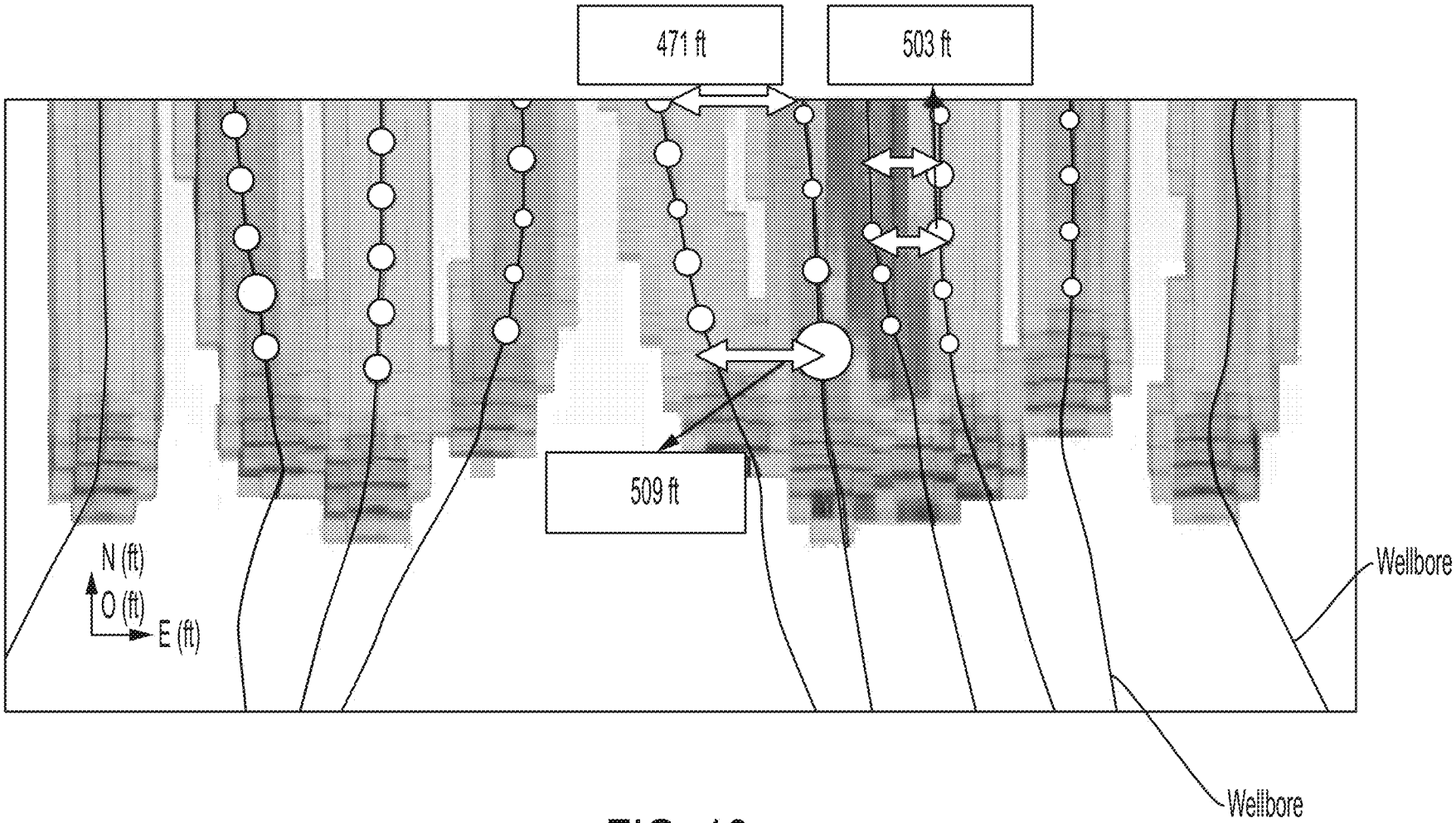
FIG. 10 displays pure-nodes and classifies that most frac-hits were caused by tight inter-well spacing.

It is noted that the machine-learning analysis can be most impactful when the data features are structured correctly, and that the output from the machine-learning algorithms can be deciphered by a domain expert. As mentioned, the classification analysis outputs multiple trees, and some can be complex with multiple levels of rules that one must investigate using the insight engine. FIG. 8 displays the results of the analysis and is one of many from the insight engine. The graph on the left side of the figure shows the importance of each feature included in the analysis. Non-limiting examples of these features are well spacing distances, total vertical depth, proppant volumes, pressure depletion, number of shots, perforation density, number of perforation clusters, total barrels of slurry, and max treating pressure. FIG. 9 visualizes the pad or reservoir asset under analysis and details the communication identified in this analysis by drawing lines from the hydraulic stages that caused the communication to the offset parent wells that saw the pressure response. The embodiment of FIG. 10 displays stage-nodes where the size of each node is correlated to the amount of frac-hits caused by that stage and classifies that most frac-hits (larger nodes) were caused by tight inter-well spacing (<~500 ft.), which can be attributed to doglegs or close well proximity at the heel and provides an insight to spacing for future development. Where spacing was greater than 500 ft., frac hits occurred due to the depleted pressure of the reservoir near the parent wells. This information inferred an optimal spacing distance is needed for infills in proximity to parent wells. This inference leads us to the statement before around additional experiments or additional feature extractions (i.e., distance to parent). The last rule displayed in the figure indicated perforation design was an influential variable and has a correlation to the frac-hits, which could be related to the number of clusters or entry points and how they are controlling near-wellbore complexity, the number of fractures, and fracture geometry. The results of this indicate reservoir depletion, offset distance, and perforation design are important to the occurrence of frac-hits, and they are now identified as the key drivers. The more meaningful aspect now is using these quantitative insights to improve operations.

The method 60 may also include drilling one or more infill wellbores having a selected trajectory based on the quantified explainers using the drilling rig 10.

To ensure the quality of the results of the machine learning, the robustness of the label that a well interference event occurred can be analyzed to ensure that it is accurate. Additional techniques can be applied at the well level, using information fusion of the well interference observations from the production interference, microseismic, and tracer data. Information fusion provides a robust assessment of the label, indicating if the stage participated in a well communication event. In this case, there are multiple channels of evidential information by which such inference can be made, including signatures in surface and bottomhole pressure gauges during the hydraulic fracturing of the stage in question, communication information analysis from oil and water tracers, information from production interference tests, and examination of microseismic events produced during fracture operations. Information fusion involves aggregating the multiple interactions and producing a single interaction matrix that maximizes the information from the diverse sources of evidence for well interaction. When multiple sources agree on a well-pair interaction, the likelihood of an interaction is increased proportionally, and vice versa.

The choice of an appropriate methodology for information fusion is driven by at least the following three properties of the data. (1) Information related to well-pair interactions can be a continuous number in the case of some sources (tracers) and binary in the case of others (pressure events in the passive well). (2) Information related to well-pair interactions can often be unavailable or missing. This must be appropriately factored in during the fusion so unavailable well-pair interactions are not over-discounted in favor of interactions for which information is readily available. (3) In some cases, information related to well interaction is unidirectional, while in other cases it is bidirectional.

Figure 11:
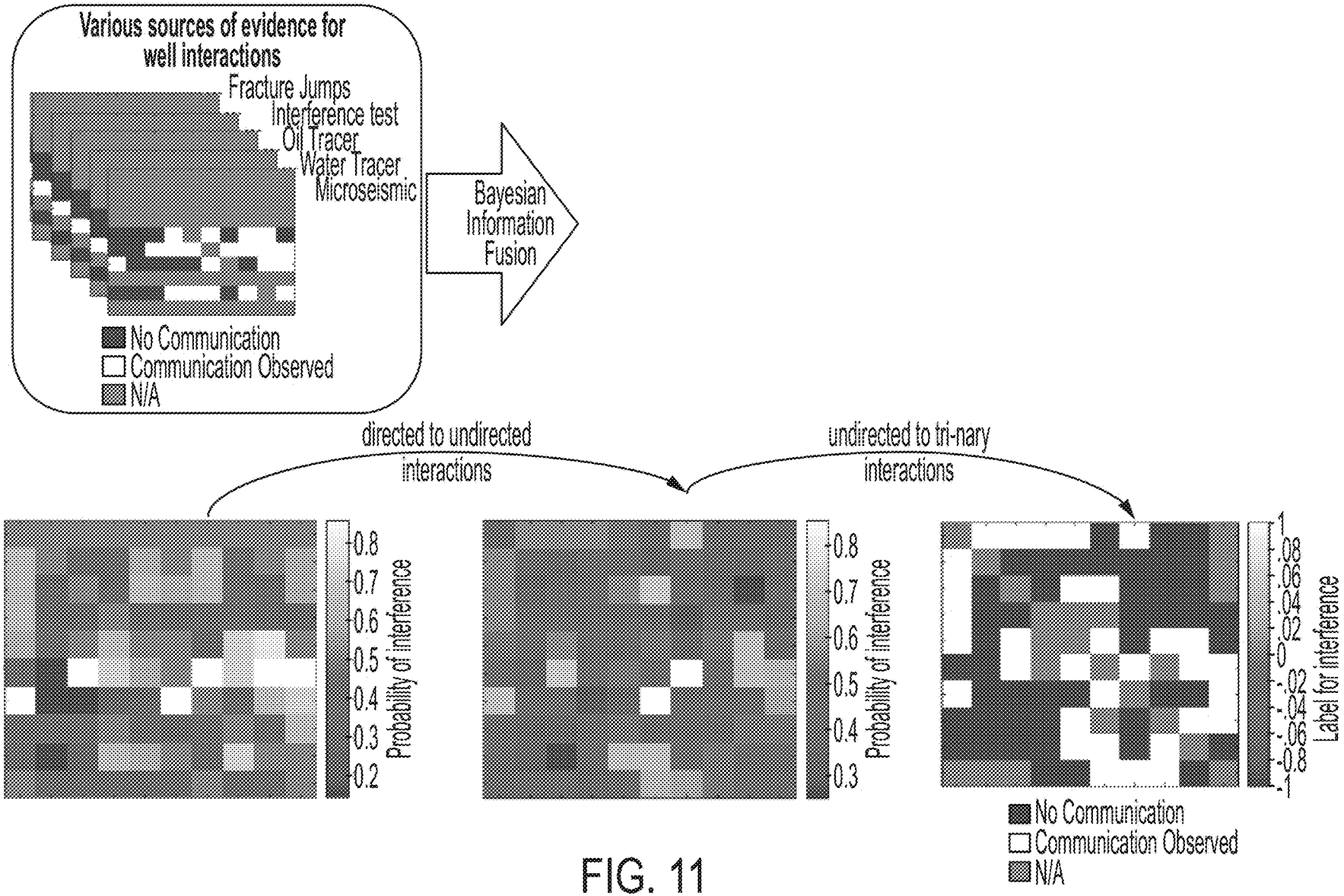
FIG. 11 depicts aspects of an information fusion process for inferring pairwise interaction.

To address the above, firstly, using appropriate thresholds where necessary, each well interaction matrix is transformed into a three-label matrix where the three entry-labels respectively correspond to the supporting, refuting, or unavailable information pertinent to inferring pairwise interaction for the entry. This set of tri-label matrices are now aggregated using Bayesian fusion to create a single well-interaction matrix where the entries are continuous in the range [0,1] and can be interpreted as probabilistic estimates of the likelihood of a well-pair interaction. If there is an additional need to get inferences from {Yes, No, Unavailable} for each well-pair interaction, the final matrix can be converted into a tri-label matrix by using appropriate thresholds, in the vicinity and either side of 0.5. In the end, a single well-interaction matrix is created that provides a robust assessment along the above three labels for each well-pair interaction being considered. The overall information fusion process is illustrated in FIG. 11.

As mentioned above, the results from the information fusion can further improve the labels derived from the anomaly diagnosis portion described earlier, or if a larger dataset is available to do classification at the well level. It can also be used for better production interference design to investigate further the results of the anomaly detection observed during the fracturing to understand the impact of the long-term fracture-to-fracture communication observed. This technique can also improve the strategy of data collection programs and value of information for understanding well interference.

Furthermore, the results can be enhanced by building out a user interface to enable visualization in two dimensions or three dimensions of the results and enable the creation of a platform to do additional work as described in the next steps. The visualization gives the observer some qualitative understanding and spatial representation of where "frac-hits" are occurring. Another visualization tab can be created to visualize each fracture stage with the corresponding passive response for each well. Set up as matrix of stage numbers and the corresponding passive well recordings enable a user to quickly navigate and choose any fracture stage and if a pressure hit occurred, indicated by a color. Overall, when dealing with large amounts of data, this enables users to navigate through the data and results relatively quickly. Overall, it enables a human to continue to hypothesize what the machine may have missed and to perform some quality assurance and/or quality control of the outcomes that can be used to refine the analytics and train the machine-learning portion of the model.

It can be appreciated that the artificial intelligence and machine learning techniques discussed herein are not limited to any specific techniques, but may include any particular techniques known in the art of artificial intelligence and machine learning that would be appropriate for the applications discussed herein such as a random forest classifier or cluster analysis.

In support of the teachings herein, various analysis components may be used, including a digital and/or an analog system. For example, the sensor 7, geo-steering system 8, downhole electronics 9, computer processing system 11, and/or controller 12 may include digital and/or analog systems. The system may have components such as a processor, storage media, memory, input, output, communications link (wired, wireless, optical or other), user interfaces (e.g., a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a power supply (e.g., at least one of a generator, a remote supply and a battery, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

The term "carrier" as used herein means any device, device component, combination of devices, media and/or member that may be used to convey, house, support or otherwise facilitate the use of another device, device component, combination of devices, media and/or member. Other exemplary non-limiting carriers include drill strings of the coiled tube type, of the jointed pipe type and any combination or portion thereof. Other carrier examples include casing pipes, wirelines, wireline sondes, slickline sondes, drop shots, bottom-hole-assemblies, drill string inserts, modules, internal housings and substrate portions thereof.

Set forth below are some embodiments of the foregoing disclosure:

Embodiment 1: A method for determining a location and trajectory for a new wellbore relative to an adjacent wellbore, the method comprising: receiving, with a processor, controllable variable data related to fracturing a formation by a stimulation operation in a first wellbore penetrating the formation: receiving, with the processor, uncontrollable variable data related to the fracturing; receiving, with the processor, pressure communication event or pressure non-communication event identification data related to identification of a pressure communication event or pressure non-communication event in a second wellbore penetrating the formation in response to the fracturing by the stimulation operation in the first wellbore; extracting, with the processor, features from the controllable variable data and the uncontrollable variable data to provide extracted features; detecting, with the processor by use of an analytic technique, a pressure communication event using the extracted features and the pressure communication event or pressure non-communication event identification data; identifying, with the processor by use of an artificial intelligence technique, one or more quantified causes of the detected pressure communication event; and determining the location and trajectory of the new wellbore using the one or more quantified causes.

Embodiment 2: The method according to any previous embodiment, further comprising drilling a third wellbore in the formation based on the one or more quantified causes such that the third wellbore is in communication with an adjacent wellbore and a depletion volume of the third wellbore overlaps a depletion volume of the adjacent wellbore by a selected amount.

Embodiment 3: The method according to any previous embodiment, wherein the controllable variable data comprises at least one of proximity or inter-well spacing, wellbore undulation, well alignment, type of facture operation, fluid injection rate for fracturing, fluid injection pressure for fracturing, fluid type for fracturing, injected fracture fluid volume, and injected proppant volume.

Embodiment 4: The method according to any previous embodiment, wherein the uncontrollable variable data comprises at least one or a regional fracture pattern, a natural fracture pattern, in-situ stress values, and a fracture barrier.

Embodiment 5: The method according to any previous embodiment, wherein the pressure communication event or pressure non-communication event identification data comprises at least one of microseismic data, production interference data, tracer data, and fracture interference data.

Embodiment 6: The method according to any previous embodiment, wherein analyzing comprises associating data identifying a pressure communication event with an extracted feature related to the pressure communication event.

Embodiment 7: The method according to any previous embodiment, wherein the data identifying a pressure communication event comprises identification of a pressure communicated in the first wellbore in response to fracturing fluid being injected in the second wellbore.

Embodiment 8: The method according to any previous embodiment, wherein the data identifying a pressure communication event comprises identification of a binary response that denotes a pressure response has occurred or a pressure response has not occurred in the first wellbore in response to the fracturing fluid being injected in the second wellbore.

Embodiment 9: The method according to any previous embodiment, wherein the data identifying a pressure communication event comprises identification of a tracer in the second wellbore that was injected in the first wellbore.

Embodiment 10: The method according to any previous embodiment, wherein the extracted feature related to the pressure communication event comprises a distance between the first wellbore and the second wellbore.

Embodiment 11: The method according to any previous embodiment, wherein the artificial intelligence technique comprises an ensemble-based random forest classifier.

Embodiment 12: The method according to any previous embodiment, wherein identifying comprises using an insight engine that is configured to review the rules and relationships in the artificial intelligence technique to present human-understandable quantified causes in a textual and/or visual format.

Embodiment 13: The method according to any previous embodiment, further comprising sensing the pressure communication event using a sensor disposed in the second wellbore.

Embodiment 14: A system for determining a location and trajectory for an infill wellbore relative to an adjacent wellbore, the system comprising: a stimulation apparatus configured for fracturing a formation through a first wellbore penetrating the formation; a sensor disposed in a second wellbore penetrating the formation and configured to acquire sensed data related to pressure communication or pressure non-communication between the first wellbore and the second wellbore due to the fracturing; and a processor configured for: receiving controllable variable data related to the fracturing: receiving uncontrollable variable data related to the fracturing; receiving pressure communication event or pressure non-communication event identification data related to identification of a pressure communication event or pressure non-communication event in the second wellbore in response to the fracturing; extracting features from the controllable variable data and the uncontrollable variable data to provide extracted features; detecting, by use of an analytic technique, a pressure communication event using the extracted features and the pressure communication event or pressure non-communication event identification data; identifying, by use of the artificial intelligence technique, one or more quantified causes of the detected pressure communication event; and determining the location and trajectory of the new wellbore using the one or more quantified causes.

Embodiment 15: The system according to any previous embodiment, wherein the sensor is configured to sense seismic data related to the fracturing and/or a tracer chemical injected into the first wellbore.

Embodiment 16: The system according to any previous embodiment, wherein the processor is further configured to provide an insight engine that is configured to review the rules and relationships in the first artificial intelligence technique and/or second artificial intelligence technique to present human-understandable quantified causes in a textual and/or visual format.

Embodiment 17: The system according to any previous embodiment, further comprising a drilling rig configured to drill a third wellbore in the formation based on the one or more quantified causes such that the third wellbore is in pressure communication with an adjacent wellbore and a depletion volume of the third wellbore overlaps a depletion volume of the adjacent wellbore by a selected amount.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The term "configured" relates one or more structural limitations of a device that are required for the device to perform the function or operation for which the device is configured.

The flow diagram depicted herein is just an example. There may be many variations to this diagram or the steps (or operations) described therein without departing from the spirit of the invention. For instance, the steps may be performed in a differing order, or steps may be added, deleted or modified. All of these variations are considered a part of the claimed invention.

The disclosure illustratively disclosed herein may be practiced in the absence of any element which is not specifically disclosed herein.

While one or more embodiments have been shown and described, modifications and substitutions may be made thereto without departing from the scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A method for determining a location and trajectory for a new wellbore relative to an adjacent wellbore, the method comprising:

receiving, with a processor, controllable variable data related to fracturing a formation by a stimulation operation in a first wellbore penetrating the formation;

receiving, with the processor, uncontrollable variable data related to the fracturing;

receiving, with the processor, pressure communication event identification data and pressure non-communication event identification data related to identification of a pressure communication event and a pressure non-communication event in a second wellbore penetrating the formation in response to the fracturing by the stimulation operation in the first wellbore, the pressure non-communication event comprising not sensing pressure communication in the second wellbore in response to the fracturing by the stimulation operation in the first wellbore, wherein pressure sensing is not in any wellbore extending from the second wellbore;

extracting, with the processor, features from the controllable variable data and the uncontrollable variable data to provide extracted features;

detecting, with the processor by use of an analytic technique, a pressure communication event using the extracted features and the pressure communication event identification data and the pressure non-communication event identification data;

identifying, with the processor by use of an artificial intelligence technique, one or more quantified causes of the detected pressure communication event; and determining the location and trajectory of the new wellbore using the one or more quantified causes.

2. The method according to claim 1, further comprising drilling a third wellbore in the formation based on the one or more quantified causes such that the third wellbore is in communication with an adjacent wellbore and a depletion volume of the third wellbore overlaps a depletion volume of the adjacent wellbore by a selected amount.

3. The method according to claim 1, wherein the controllable variable data comprises at least one of proximity or inter-well spacing, wellbore undulation, well alignment, type of facture operation, fluid injection rate for fracturing, fluid injection pressure for fracturing, fluid type for fracturing, injected fracture fluid volume, and injected proppant volume.

4. The method according to claim 1, wherein the uncontrollable variable data comprises at least one of a regional fracture pattern, a natural fracture pattern, in-situ stress values, and a fracture barrier.

5. The method according to claim 1, wherein the pressure communication event or pressure non-communication event identification data comprises at least one of microseismic data, production interference data, tracer data, and fracture interference data.

6. The method according to claim 1, wherein analyzing comprises associating data identifying a pressure communication event with an extracted feature related to the pressure communication event.

7. The method according to claim 6, wherein the data identifying a pressure communication event comprises identification of a pressure communicated in the first wellbore in response to fracturing fluid being injected in the second wellbore.

8. The method according to claim 7, wherein the data identifying a pressure communication event comprises identification of a binary response that denotes a pressure response has occurred or a pressure response has not occurred in the first wellbore in response to the fracturing fluid being injected in the second wellbore.

9. The method according to claim 6, wherein the data identifying a pressure communication event comprises identification of a tracer in the second wellbore that was injected in the first wellbore.

10. The method according to claim 6, wherein the extracted feature related to the pressure communication event comprises a distance between the first wellbore and the second wellbore.

11. The method according to claim 1, wherein the artificial intelligence technique comprises an ensemble-based random forest classifier.

12. The method according to claim 1, wherein identifying comprises using an insight engine that is configured to review the rules and relationships in the artificial intelligence technique to present human-understandable quantified causes in a textual and/or visual format.

13. The method according to claim 1, further comprising sensing the pressure communication event using a sensor disposed in the second wellbore.

14. A system for determining a location and trajectory for an infill wellbore relative to an adjacent wellbore, the system comprising:

a stimulation apparatus configured for fracturing a formation through a first wellbore penetrating the formation;

a sensor disposed in a second wellbore penetrating the formation and configured to acquire sensed data related to pressure communication and pressure non-communication between the first wellbore and the second wellbore due to the fracturing; and a processor configured for:

receiving controllable variable data related to the fracturing;

receiving uncontrollable variable data related to the fracturing;

receiving pressure communication event identification data and pressure non-communication event identification data related to identification of a pressure communication event and a pressure non-communication event in the second wellbore in response to the fracturing, the pressure non-communication event comprising not sensing pressure communication in the second wellbore in response to the fracturing by the stimulation operation in the first wellbore, wherein the sensor is not disposed in any wellbore extending from the second wellbore;

extracting features from the controllable variable data and the uncontrollable variable data to provide extracted features;

detecting, by use of an analytic technique, a pressure communication event using the extracted features and the pressure communication event identification data and the pressure non-communication event identification data;

identifying, by use of an artificial intelligence technique, one or more quantified causes of the detected pressure communication event; and determining the location and trajectory of the new wellbore using the one or more quantified causes.

15. The system according to claim 14, wherein the sensor is configured to sense seismic data related to the fracturing and/or a tracer chemical injected into the first wellbore.

16. The system according to claim 14, wherein the processor is further configured to provide an insight engine that is configured to review the rules and relationships in the artificial intelligence technique to present human-understandable quantified causes in a textual and/or visual format.

17. The system according to claim 14, further comprising a drilling rig configured to drill a third wellbore in the formation based on the one or more quantified causes such that the third wellbore is in pressure communication with an adjacent wellbore and a depletion volume of the third wellbore overlaps a depletion volume of the adjacent wellbore by a selected amount.

* * * * *